United States Patent [19]

Ezaki et al.

[11] Patent Number: 4,858,659

[45] Date of Patent: Aug. 22, 1989

[54] METHOD FOR FORMING AND CUTTING A FLAT TYPE MULTI-CORE CABLE AND APPARATUS FOR REALIZING SAME

[75] Inventors: Satoru Ezaki; Kiyofumi Tanaka, both of Hadano; Tsukasa Kasahara; Tetsuya Hirose, both of Hitachi; Tetsuro Nakagawa, Takahagi, all of Japan

[73] Assignees: Hitachi, Ltd.; Hitachi Cable, Ltd., both of Tokyo, Japan

[21] Appl. No.: 215,534

[22] Filed: Jul. 6, 1988

[30] Foreign Application Priority Data

Jul. 6, 1987 [JP] Japan ..... 62-167108

[51] Int. Cl.[4] ..... B21F 1/00

[52] U.S. Cl. ..... 140/105

[58] Field of Search ..... 140/105; 29/556.1, 566.2

[56] References Cited

U.S. PATENT DOCUMENTS 4,219,913 9/1980 Johnson ..... 29/566.1
4,557,046 12/1985 Suzuki et al. ..... 140/105
4,572,250 2/1986 Maben ..... 140/105
4,765,044 8/1988 Wilson et al. ..... 140/105

FOREIGN PATENT DOCUMENTS 57-192711 12/1982 Japan .

*Primary Examiner*—Robert L. Spruill
*Attorney, Agent, or Firm*—Fay, Sharpe, Beall, Fagan, Minnich & McKee

[57] ABSTRACT

An apparatus for forming and cutting a flat type multi-core cable is disclosed, in which core conductors of a flat type multi-core cable, whose core conductors are previously exposed by exfoliating a part of a jacket therefor, are divided into a plurality of units; the core conductors are formed and cut separately for every unit; and at the same time the pitch of the core conductors is corrected. Further the number and/or the pitch of the core conductors are calculated by using information obtained by the scanning of the core conductors and cables, for which the number of the core conductors is not in agreement with predetermined one, or cables, for which errors in the pitch of the core conductors exceed a certain limit, are excluded as deficiencies.

13 Claims, 10 Drawing Sheets

METHOD FOR FORMING AND CUTTING A FLAT TYPE MULTI-CORE CABLE AND APPARATUS FOR REALIZING SAME

BACKGROUND OF THE INVENTION

This invention relates to treatment of terminals of a high speed transmission cable used for an electronic computer, etc. and in particular to a method for forming and cutting a flat type multi-core cable, which is necessary for a provisional treatment, when a terminal of the flat type multi-core cable is jointed to a connector or a printed wiring board and to an apparatus for realizing the same.

As prior art techniques concerning the method for forming and cutting a flat type multi-core cable and the apparatus for realizing the same there is known a technique disclosed e.g. in JP (Utility Model)-A-57-192711.

According to this kind of prior art techniques all the core conductors are formed and cut together at an end of the cable by means of a comb-shaped die fabricated so that the pitch thereof is in accordance with the standard pitch of the cable. Consequently, unless errors of the pitch of the core conductors in the cable are smaller than a predetermined value, it is impossible to form them and further this technique is not applicable to a multi-core cable meeting increase of speed and density used in an electronic computer, etc. and to the treatment of a multi-core coaxial cable.

Hereinbelow an example of this kind of prior art techniques will be explained, referring to several figures.

FIG. 1 is a perspective view of a flat type multi-core cable, which is to be formed and cut; FIG. 2 is a perspective view illustrating a form of treatment of the flat type multi-core cable; FIG. 3 is a perspective view for explaining the positioning of the core conductors at a pattern; FIG. 4 is a side view illustrating an apparatus for forming and cutting a flat type multi-core cable according to a prior art technique; and FIG. 5 is a flow chart for explaining the working mode of the apparatus indicated in FIG. 4. In FIGS. 1 to 4 reference numeral 1 represents a flat type multi-core cable; 2 a jacket; 3 exfoliated core conductors; 4 core conductors; 5 signal lines; 6 ground lines; 7 a cross-section of the flat type multi-core cable; 8 a cable clamp for securing the cable 1; 9 cylinders for moving the cable clamp up- and downwards; 10 a uniaxial table; 11 a screw; 12 a step motor; 13 a lumping comb-shaped lower die; 14 a lumping comb-shaped upper die; 15 a transmission type photo-electric sensor; 16 a base plate; **16*a* a pattern with which the core conductors are to be connected; and 24** a driver.

The flat type multi-core cable 1, which is to be formed and treated, is so constructed that a plurality of core conductors are molded in the jacket 2 so as to be parallel to each other, as indicated in FIG. 1. When a terminal of the core conductors is treated, a part of the jacket 2 in the terminal portion of the flat type multi-core cable 1 so that the core conductors 4 are exposed there in the form of the exfoliated core conductors 3. Each of the core conductors 4 consists of e.g. a signal line 5 and two ground lines 6. However it may be composed of respective one of them. The exfoliated core conductors 3 are formed in the shape indicated in FIG. 2 by means of the forming and cutting apparatus and thereafter they are connected with the connection pattern **16*a* on the base plate 16, as indicated in FIG. 3**.

The forming and cutting apparatus for forming the exfoliated core conductors 3 in the form indicated in FIG. 2 consists of the step motor 12 rotating the screw 11; a uniaxial table 10 movable in the axial direction of the screw 11 by the rotation thereof; a cable clamp 8 disposed on the cylinders 9; a transmission type photoelectric sensor 15; a shape forming die composed of a lumping comb-shaped lower die 13 and a lumping comb-shaped upper die 14; a counter 18 counting detection signals coming from the sensor 15; a pulse generator 20 outputting pulses, depending on the content of the counter 18; and a driver 24 amplifying pulses outputted by the pulse generator 20 and supplying them to the motor 12 so as to drive it. On the uniaxial table 10 there are disposed the shape forming die and the sensor 15 described above movably together with the table 10 so as to be distant from each other by a distance l. Further the table 10 is controlled to be moved by the driver 24 driving the step motor 12, responding to the pulse signal coming from the pulse generator 20.

The operation to form the exfoliated core conductors 3 of the flat type multi-core cable 1 by means of the forming and cutting apparatus thus constructed according to the prior art technique will be explained below, referring to the flow chart indicated in FIG. 5.

(1) The terminal jacket 2 of the flat type multicore cable 1 is removed and the terminal portion of the flat type multi-core cable 1 is secured with the cable clamp 8. Thereafter the shape forming die and the sensor 15 are moved towards the cable clump (Flow 51, 52).

(2) The transmission type photoelectric sensor 15 detects the core conductors 3 of the secured flat multi-core cable 1, when it has reached the position of the cable clamp 8 owing to the movement of the table 10 and gives the counter 18 its detection signals. The counter 18 counts the detection signals and gives the pulse generator 20 an ON signal, when the count has reached a half of the number of the core conductors of the multi-core cable 1, which is previously determined (Flow 53).

(3) When the pulse generator 20 receives the ON signal from the counter 18, it generates a pulse so that the uniaxial table 10 is moved towards the cable clamp 8 further by a distance l between the sensor 15 and the center of the shape forming die from that point of time. Receiving this pulse, the driver 24 drives the step motor 12 so as to move the uniaxial table 10. As the result, the center of the shape forming die consisting of the lumping comb-shaped lower die 13 and the lumping comb-shaped upper die 14 on the uniaxial table 10 is in agreement with the position of the central core conductor 3 in the flat type cable secured by the cable clump 8 (Flow 54).

(4) In this state the shape forming die consisting of the lumping comb-shaped lower die 13 and the lumping comb-shaped upper die 14 is closed and the signal lines 5 and the ground lines 6 of all the core conductors 3 in the flat type cable 1 are formed in a predetermined shape and cut (Flow 55).

(5) After that the shape forming dies 13, 14 are opened and the counter 18 is reset. The uniaxial table 10 is returned to its original position and the cable clamp 8 is loosened. In this way a series of treatments are terminated (Flow 56–59).

As explained above, in the treatment of the core conductors in the flat type cable according to the prior art technique, all the core conductors in the flat type cable are formed simultaneously after having brought the center of the flat type cable so as to be in agreement with the center of the comb-shaped die.

The prior art technique described above has a problem that, in the case where there exist some errors in the pitch of the core conductors because of a restriction in the fabrication of the cable, even if the center of the cable and the center of the shape forming die are in good agreement with each other, outer core conductors of the cable 1 are not always brought on teeth of the shape forming die, which gives rise to impaired core conductors or not well worked core conductors, when the shape forming die is closed. Further the prior art technique has no function to correct the precision of the pitch size between two adjacent core conductors among precisions of the size after the formation of the core conductors. Consequently, since the pitch size after the formation of the core conductors is basically identical to that of the cable itself, when errors in the pitch size of the core conductors exceed a certain threshold value, an imperfectly positioned portion 17 between the pattern 16*a* and the core conductors arises at the connection thereof with the pattern 16*a* on the base plate 16. Further the prior art technique has another problem that when two adjacent core conductors are brought close to each other by some cause, before the flat type cable is formed and cut, the sensor cannot distinguish the two core conductors and the counter counts the two core conductors as one, or on the contrary it can happen for one core conductor to be counted as 2 due to vibration, etc. at the movement of the table, which gives rise to another problem that in some cases the central core conductor cannot be brought surely so as to be in agreement with the center position of the shape forming die.

SUMMARY OF THE INVENTION

The object of this invention is to provide a method for forming and cutting a flat type multi-core cable and an apparatus for realizing same capable of resolving the problems described above of the prior art technique, forming and cutting surely core conductors in a flat type multi-core cable, in which core conductors are arranged with a high density, a flat type multi-core cable in which core conductors are arranged with relatively great errors, etc. without impairing the core conductors, and in addition correcting the pitch of the core conductors.

According to this invention the above object can be achieved by effecting formation and cutting of the core conductors one after another or dividing them into a suitable number of units and effecting them for every unit instead of treating all the core conductors together by means of the comb-shaped forming die and at the same time by correcting the pitch of the core conductors. Furthermore the cables, whose number of core conductors is not in agreement with that previously determined, referring to the number of core conductors and the pitch thereof calculated on the basis of information obtained from the sensor, or the cables, for which errors in the pitch of the core conductors exceed a certain limit, are excluded as deficiencies.

Data representing the position of the core conductors detected by the sensor are sent to an operating device such as a micro-computer, etc. The operating device such as a microcomputer positions one core conductor or a unit consisting of a plurality of core conductors at the shape forming sharp edged die on the basis of these position data and carries out treatments to cut and form the core conductors one after another or for every unit consisting of a plurality of core conductors. Next the operating device such as a microcomputer corrects the pitch of the core conductors by shifting the core conductors while holding them with the shape forming sharp edged die by the difference between the standard pitch previously stored of the core conductors in the flat type multi-core cable to be treated and the measured pitch. According to this invention this operation is repeatedly effected for every core conductor or for every unit consisting of a plurality of core conductors. In this way it is possible to effect surely formation and cutting of the core conductors in the flat type multi-core cable without impairing them and at the same time to correct the pitch of the core conductors.

DESCRIPTION OF THE PREFERRED EMBODIMENTS

Hereinbelow an embodiment of the apparatus for forming and cutting a flat type multi-core cable according to this invention will be explained more in detail, referring to some figures.

Figure 6:
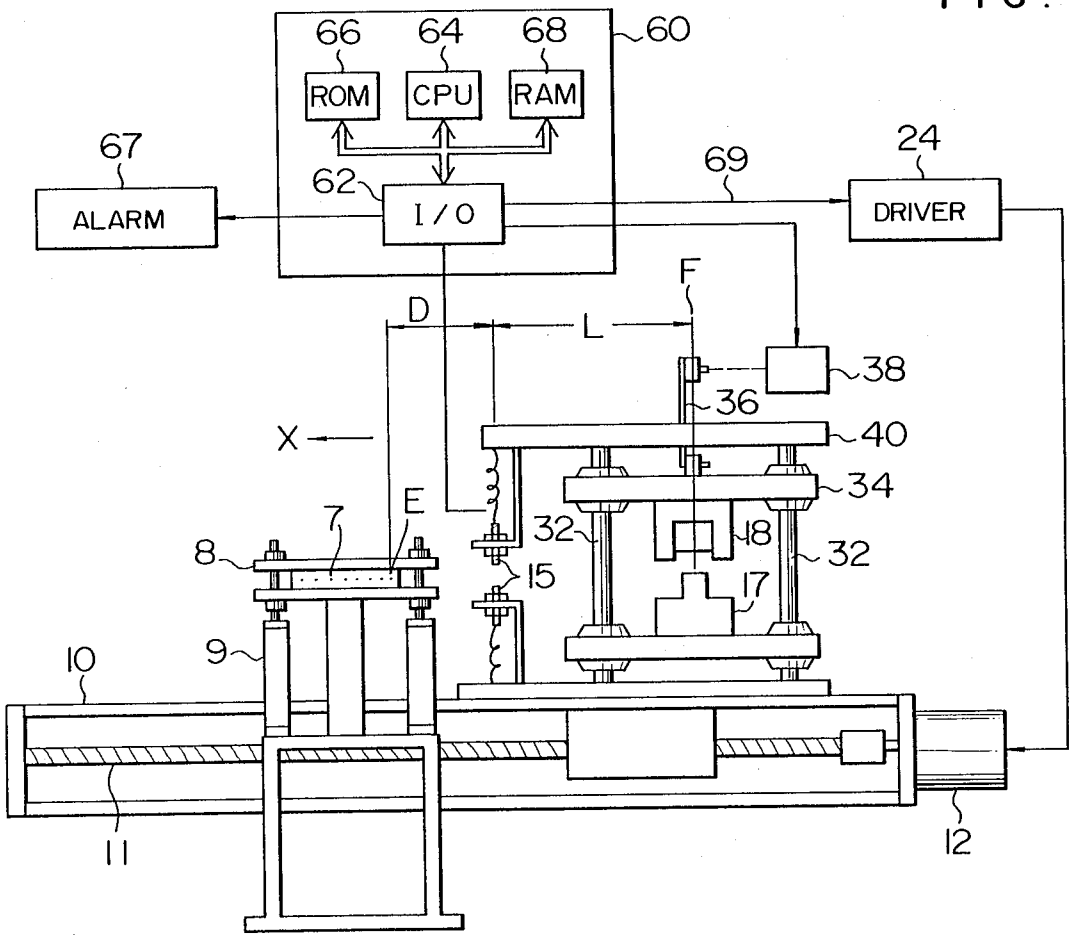
FIG. 6 is a side view illustrating an embodiment of the flat type multi-core cable forming and cutting apparatus according to this invention.
Figure 7:
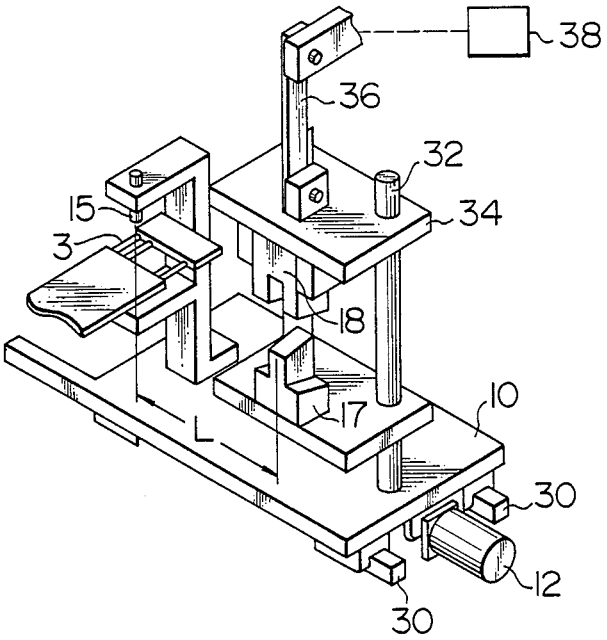
FIG. 7 is a perspective view showing principal parts of the apparatus illustrated in FIG. 6.
Figure 8:
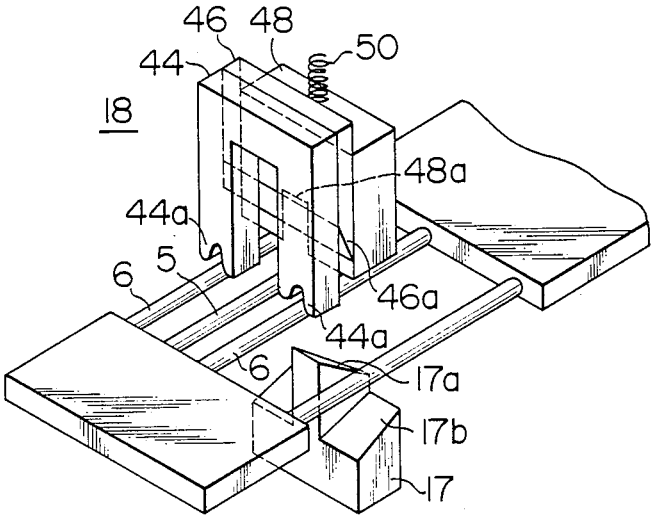
FIG. 8 is a perspective view illustrating the unit forming die indicated in FIG. 7.

FIG. 6 is a side view illustrating an embodiment of the flat type multi-core cable forming and cutting apparatus for realizing the method according to this invention; FIG. 7 is a perspective view showing principal parts of the apparatus illustrated in FIG. 6; FIG. 8 is a perspective view illustrating the shape forming upper and lower dies indicated in FIGS. 6 and 7; and FIGS. 9A–9E show steps for forming the core conductors. In these figures items having same reference numbers as those in FIG. 4 have identical functions. Further, in these figures, 17 represents a unit forming lower die and 18 a unit forming upper die. According to this invention formation and cutting of the core conductors are effected one after another or for every unit consisting of a certain number of core conductors instead of using the lumping comb-shaped forming die, which treats all the core conductors together, in the apparatus according to the prior art technique indicated in FIG. 4. In this embodiment an apparatus, which forms and cuts the core conductors one after another, will be shown as an example. Further it is supposed as an example that one core conductor consists of a signal line and two ground lines.

Figure 4:
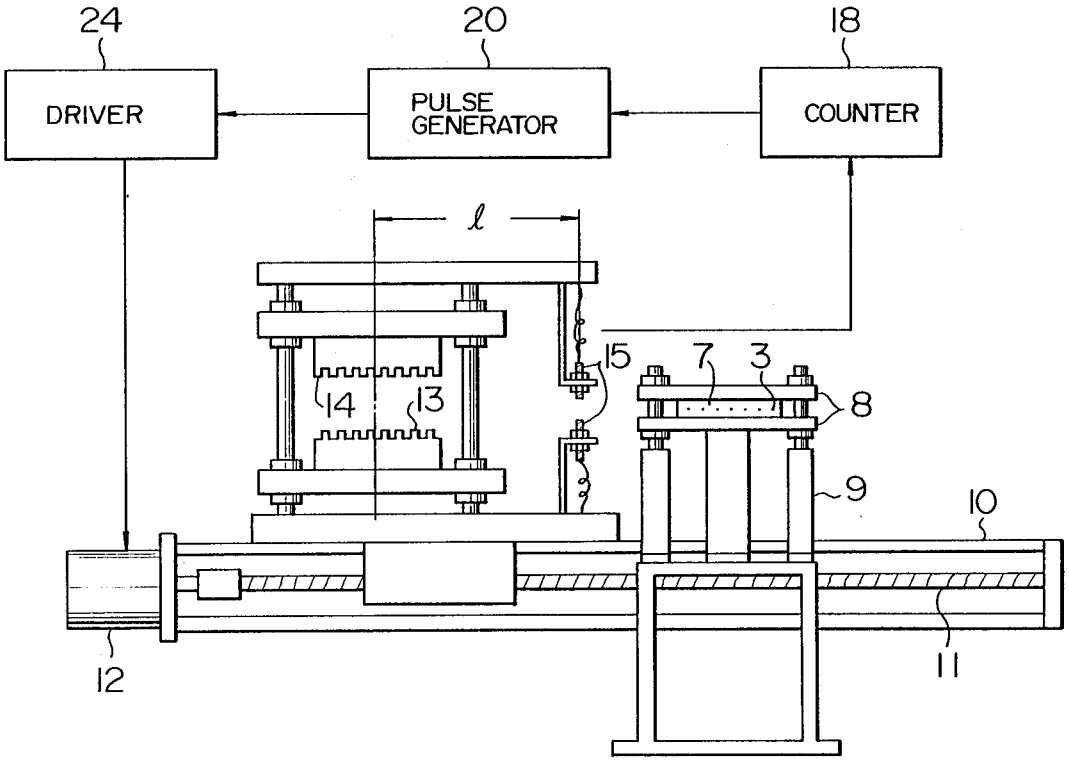
FIG. 4 PRIOR ART
FIG. 4 is a side view showing a flat type multicore cable forming and cutting apparatus according to a prior art technique.
Figure 5:
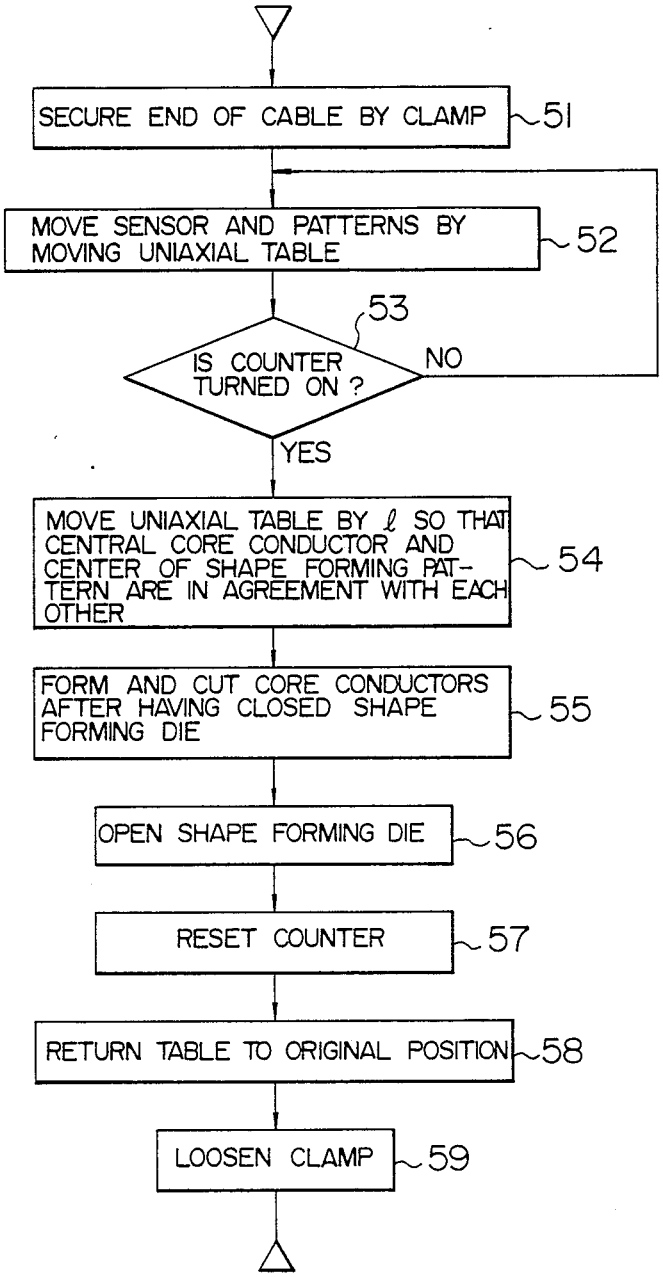
FIG. 5 PRIOR ART
FIG. 5 is a flow chart for explaining the working mode of the apparatus illustrated in FIG. 4.

In addition, the apparatus differs from that indicated in FIG. 4 according to the prior art technique in that it is provided with an operating device 60 such as a microcomputer, which receives directly output signals of the sensor 15 to treat them and controls the driver 24, instead of the counter counting the number of the core conductors and the pulse generator controlling the driver 24. The operating device 60 receives output signals of the sensor 15 and at the same time includes an I/0 circuit 62, an ROM 66, an RAM 68 and a CPU 64 giving the driver 24 and the motor 38 output pulses.

The motor 38 indicated in FIG. 6 is driven so as to lower an arm 36, responding to the output signals of the I/0 circuit 62. In this way the shape forming upper die 18 is lowered so as to be engaged with the shape forming lower die. An end of the arm 36 is fixed to a plate 34, which is supported by pillars 32 slidably up- and downward along the pillars 32. A part of the sensor 15 is fixed to a plate 40 secured to the pillars 32 and the other part thereof is fixed to the table 10.

The shape forming upper die 18 includes a plunger 44, a cutter 46, an upper die 48, a thrusting spring 50 and a housing 52, as indicated in FIG. 8 and FIGS. 9A–9E. The upper ends of the plunger 44 and the cutter 46 are fixed to the plate 34. The plunger 44 has a groove at the extremity of each of two legs 44*a*, which is so constructed that each of the ground lines of the core conductor is held between a part 17*b* of the shape forming lower die 17 and the wall of the groove. The cutter 46 is so constructed that the signal line 5 and the ground lines 6 are cut by the extremity portion 46*a* thereof. The upper die 48 has a groove portion 48*a* and holds the signal line between the wall thereof and the protruding portion 17*a* of the shape forming lower die 17.

The upper end of the upper die 48 is secured to the plate 34 through the thrusting spring 50. The upper die 48 is disposed in the housing 52, slidably up- and downward therein.

Figure 1:
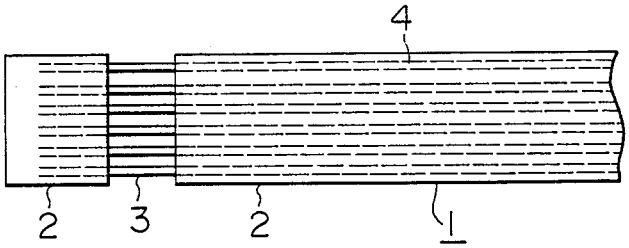
FIG. 1 is a plan view of a flat type multi-core cable, which is to be formed and treated according to this invention.
Figure 2:
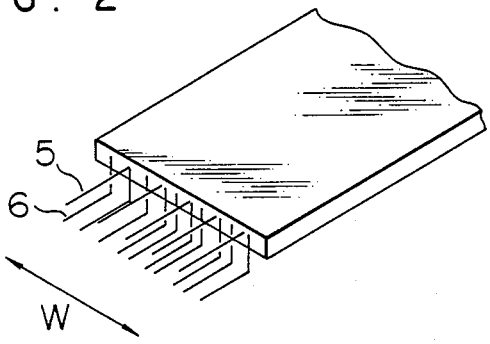
FIG. 2 is a perspective view illustrating the state of the flat type multi-core cable after formation and treatment thereof.
Figure 3:
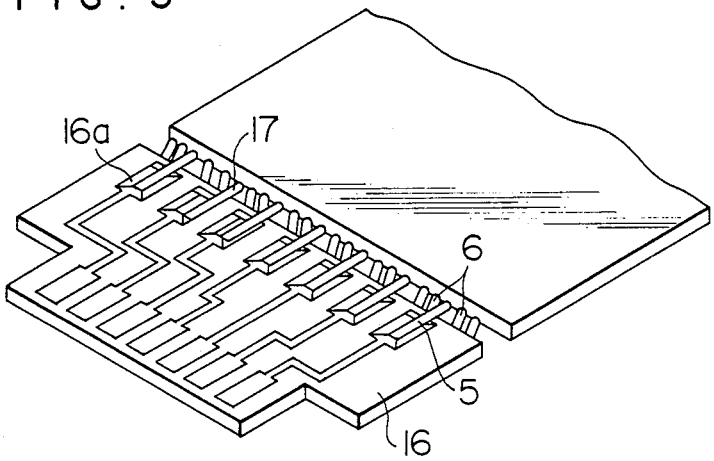
FIG. 3 is a scheme for explaining the positioning of the core conductors in the cable at a pattern on a base plate.

The operation to form the exfoliated core conductors 3 of the flat multi-core cable 1 as indicated in FIG. 1 by means of the apparatus constructed as described above according to the embodiment of this invention will be explained, referring to the flow chart indicated in FIG. 12.

The end portion of the jacket 2 of the flat type multi-core cable 1 is removed and the terminal portion of the cable 1 is secured with the cable clamp 8 (Step 81). Then the uniaxial table 10, on which the shape forming sharp edged die and the sensor 15 are located, is positioned at the origin 0 (Step 82). After that, the table 10 is moved towards the cable clump 8 by a predetermined distance D and the sensor 15 is positioned at the position E of the outermost core conductor of the cable. Finally the sensor 15 is moved in the X-direction so that all the core conductors in the flat type cable 1 are sensed one after another (Step 83).

Figure 10:
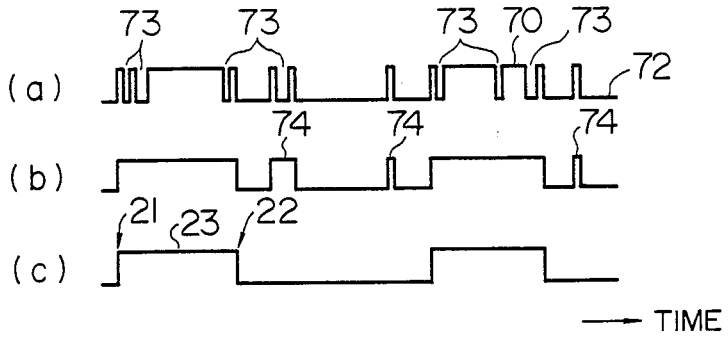
FIG. 10 shows waveforms for explaining the treatment of output signals of the core conductor detecting sensor.

When the core conductors are sensed the transmission type photoelectric sensor 15 outputs a signal, on which many noises are superposed in regions 72, where there are no detection signals as well as in regions 70, where there exist detection signals, e.g. as indicated in (a) of FIG. 10. In the embodiment of this invention the outputted signal is corrected to the signal waveform as indicated in (b) of FIG. 10 by effecting treatment to fill up lacks of the signal, whose width is smaller than a predetermined value and which are in the region 70, where there exist detection signals. Finally the sensed waveform is corrected to that indicated in (c) of FIG. 10 by erasing noise signals, whose width is smaller than the predetermined value, and which are in the region 72, where there are no detection signals.

Figure 11:
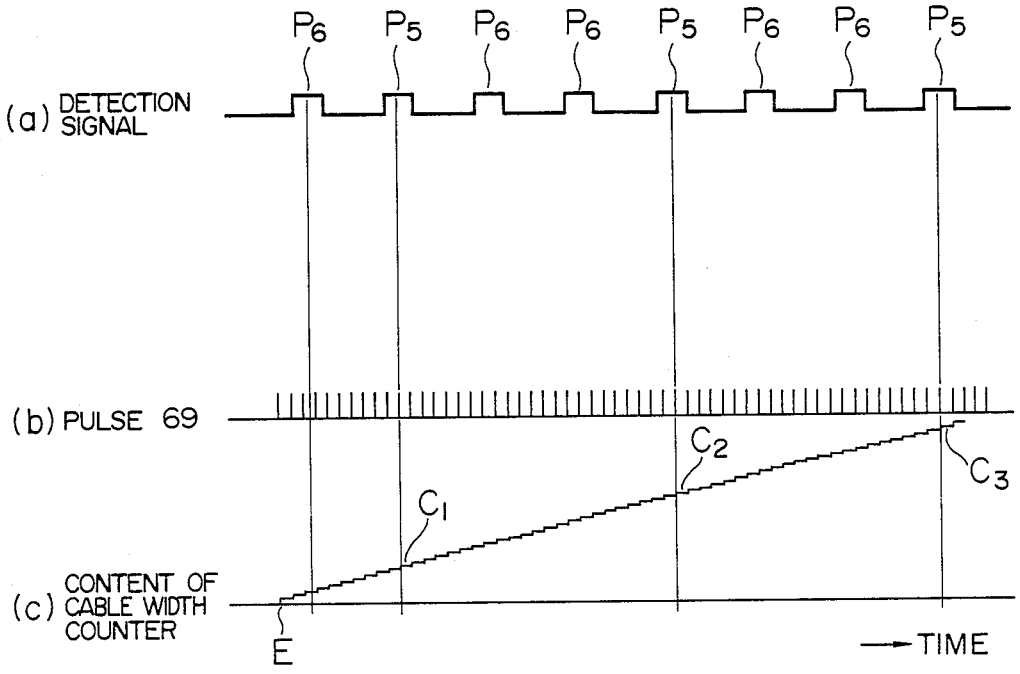
FIG. 11 shows waveforms for explaining the treatment for detecting the position of the core conductors.

Now the operation for sensing the core conductors will be explained by using the waveforms indicated in FIGS. 10 and 11 and the flow chart indicated in FIG. 13. The flow chart indicated in FIG. 13 corresponds to Step 83 in FIG. 12.

At first at Step 100 the content of a cable width counter, which is a soft counter within the RAM, is cleared. The cable width means the width W of all the core conductors in the cable.

Next the line starting point setting flag and the line ending point setting flag are cleared, i.e. they are set at "0" (Step 102). Hereinafter, a "line" means a ground line or a signal line. These two flags are set at a predetermined area in the RAM 68.

Then it is checked whether there is a detection signal from the sensor 15 or not. In the case where there is no detection signal, the process proceeds to Step 122 and it is checked whether "1" is set or not as the line starting point setting flag. In the case where it is "0", the process proceeds to Step 116 and a pulse 69 is outputted to the driver 24 so that the uniaxial table is moved by a predetermined distance, e.g. by 5 μm. Thereafter the content of the cable width counter is increased by 1 (Step 118). Then it is checked whether the count value is greater than a predetermined value $C_W$ corresponding to the width W or not (Step 120). When it is below $C_N$, it is judged that the sensing of all the core conductors is not yet terminated and the process returns to Step 104.

When a detection signal from the sensor 15 is detected, it is checked in Step 106 whether "1" is set or not as the line starting point setting flag. When it is set, the process proceeds to Step 112 and unless otherwise a flag "1" is set in Step 108.

Then, in Step 110, a line width counter, which is a soft counter within the RAM, is cleared. The line width means the width of one signal line or one ground line. Next, in Step 112, a no line detection counter, which is a soft counter within the RAM, is cleared. After that, the process proceeds to Step 114 and the content of the line width counter is increased by 1. Then Steps 116 to 120 are executed.

In this way, after detection signals have been repeatedly detected, in Step 104, when any detection signal is detected no more, the process proceeds to Step 124 through Step 122 and the content of the no line detection counter is incremented by 1.

Then, in Step 126, it is checked whether the content of the no line detection counter is smaller than a predetermined value, e.g. 3, or not. If it is smaller than the value, it is considered that the no line detection state of the detection signal is produced by noise and there exists originally a detection signal and the process proceeds to Step 114. This treatment means e.g. that parts 73 in the waveform of the detection signal indicated in (a) of FIG. 10 are filled so as to obtain the state indicated in (b) of FIG. 10.

On the other hand, when it is judged in Step 126 that the count value of the no line detection counter is greater than 4, it is checked in Step 128 whether the content of the line width counter is greater than the predetermined value $L_W$ or not. When it is smaller than the predetermined value, the treatment is effected, judging that the detection signal is a noise. For example, the parts 74 in the detection signal waveform after the filling treatment indicated in (b) of FIG. 10 are judged to be noises and erased.

When it is judged in Step 128 that the content of the line width counter is greater than the predetermined value $L_W$, it is judged that the detection signal is correct and the line ending point setting flag is set to "0" (Step 130). In this way a correct detection signal as indicated in (c) of FIG. 10 is obtained.

Then the process proceeds to Step 132, where the width of the lines and the position thereof are calculated on the basis of the content of the line width counter and the cable width counter. The position of a line may be defined e.g. to be the middle point 23 between the rising edge 21 and the falling edge 22 of the detection signal indicated in (c) of FIG. 10.

Figure 12:
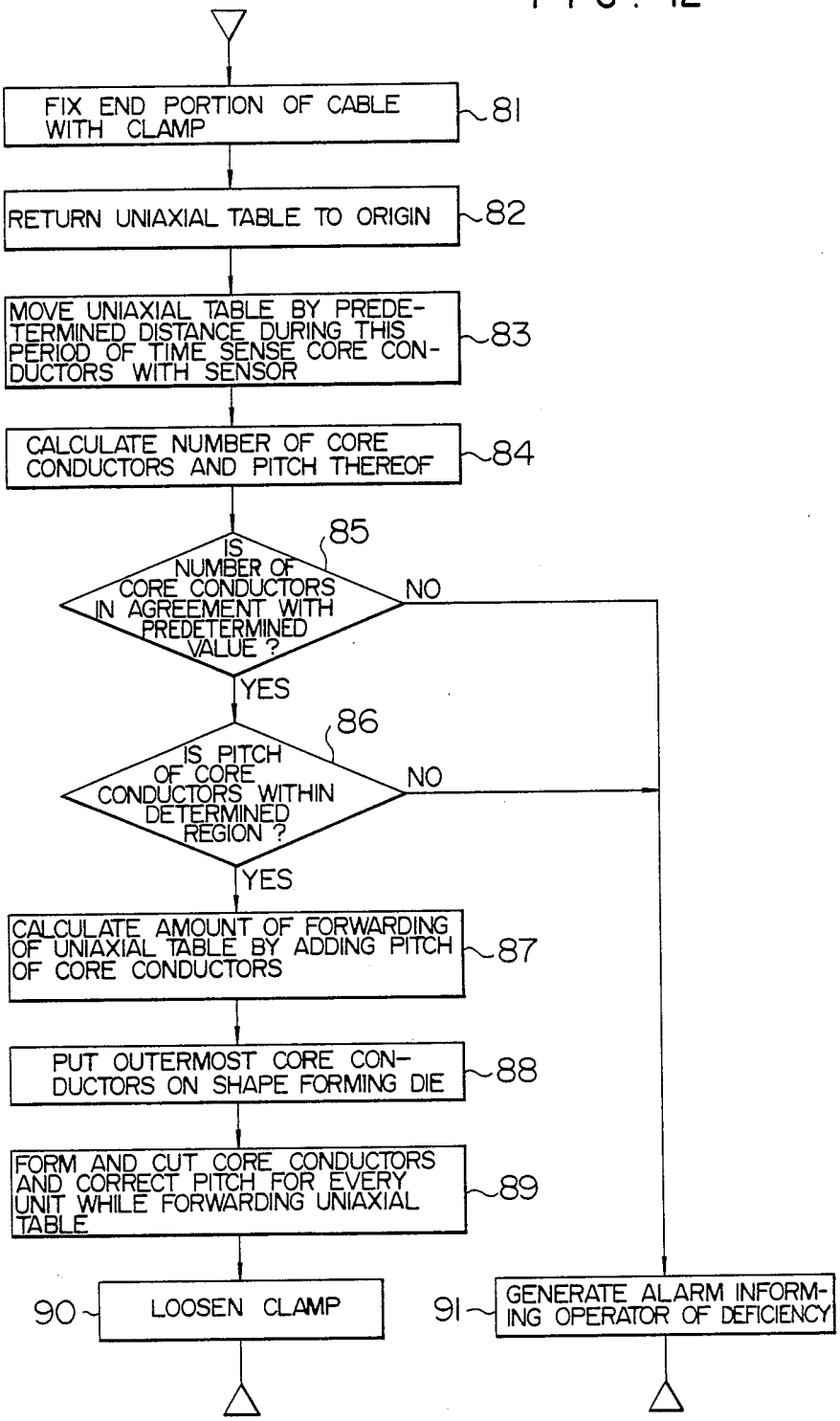
FIG. 12 is a flow chart showing the treatment for forming and cutting the cable according to this invention.

When the sensing treatment of the core conductors in Step 83 is terminated in this way in Step 84 in FIG. 12, the uniaxial table is returned to the origin 0 or to the position E of the outermost core conductor in the cable. Here it is supposed that it is returned to the position E.

Next the number of the core conductors and the pitch thereof are calculated on the basis of the position of the lines obtained by the core conductor sensing treatment. In FIG. 11, (a) indicates the waveform of the detection signal obtained by the sensing treatment, in which $P_6$ is a detection signal representing a ground line and $P_5$ is one representing a signal line, (b) indicates driving pulses 69 supplied to the driver 24 and (c) the content of the cable width counter. Consequently the number of core conductors, i.e. the number of signal lines may be obtained by counting the number of detection signals $P_5$. The pitch of the core conductors, i.e. the pitch of signal lines is represented by differences $(C_2-C_1)$, $(C_3-C_2)$, . . . $(C_n-C_{n-1})$ between adjacent two of contents $C_1$, $C_2$, . . . of the cable width counter corresponding to center positions of the detection signals $P_5$.

The sequencial number of the signal lines among the detection signals can be represented by $(3_n+2)$ (n; 0, 1, 2, . . . ). Further it is supposed that, in (a) and (c) of FIG. 11, the rising point of the first detection signal $P_6$ and the point E are slightly away from each other.

Next, in Step 85, it is checked whether the detected number of core conductors is in agreement with a predetermined number stored in the RAM (the number of signal lines included in the flat type cable 1, which is to be treated) or not. In the case where they are not in agreement with each other, in Step 91, a signal is supplied to an alarm generator 67 so as to generate an alarm informing an operator of the deficiency of the flat type multi-core cable to be treated. The alarm generator may be a speaker, a lamp displaying the alarm, etc. Further both the ground lines and the signal lines also may be counted for the number of core conductors.

When the alarm is generated in this way, the treatment is interrupted and the cable is exchanged. Then the process is started again from Step 81.

If it is judged that the number of core conductors is in agreement with the predetermined value, in Step 86, it is checked whether the pitch of the core conductors is within a predetermined region stored in the RAM. If it is judged that it is outside of the predetermined region, the cable is judged to be deficient and the process proceeds to Step 91.

Next, in Step 87, the number l of pulses 69 corresponding to the offset distance L between the sensor 15 and the shape forming sharp edged die is added to the position $C_1$ of the first signal line from the position E and the amount of forwarding $S_1$ (corresponding to the number of pulses 69) from the position F of the shape forming dies 17 and 18 at the offset position (FIG. 6) to the first signal line is obtained. Further the amount of forwarding $S_2$ from the position F to the second signal line is obtained by adding $C_2$ to l. The amount of forwarding to every following signal line is obtained in the same manner and stored in the RAM.

Next the correct amount of forwarding $S_2'$ from the position F to the second signal line is obtained by adding the predetermined correct pitch of the core conductors (stored previously in the RAM) i.e. the standard pitch p to the amount of forwarding from the position F to the first signal line, i.e. $S_1=l+C_1$. The correct amount of forwarding to the third signal line $S_3'=l+C_1+2p$ is obtained in the same manner. The correct amount of forwarding to every following signal line is obtained and stored in the RAM.

Figure 9A:
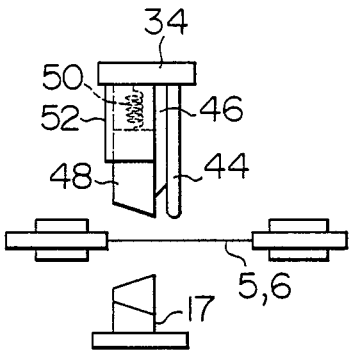
FIGS. 9A–9E are schemes for explaining the working mode of the unit forming die.
Figure 9B:
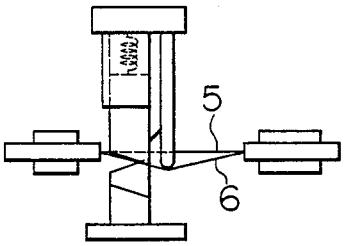
Figure 9C:
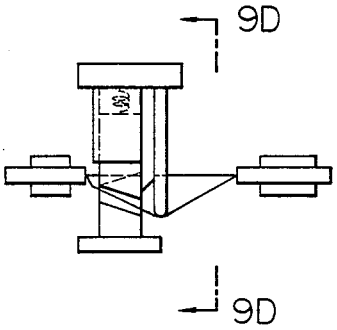

Then the amount of forwarding $S_1$ from the position F to the first signal line is read out from the RAM and a number of pulses 69 corresponding to the amount of $S_1$ are given to the driver 24 so as to move the uniaxial table so that the shape forming dies 17 and 18 are put on the first signal line (FIG. 9A). Next a driving signal is given to the motor 38 to lower the upper die 18 (FIG. 9B). Then the groove portion 44*a* of the plunger 44 thrusts the ground line 6 downward. Further, when the shape forming upper die 17 is lowered, the signal line 5 is put between the wall of the groove portion 48*a* of the upper die 48 and the protruding portion 17*a* of the lower die 17 and secured there. In this state, since the upper die 48 is prevented from lowering by the protruding portion 17*a* of the lower die 17, only the cutter 46 and the plunger 44 are lowered.

Figure 9D:
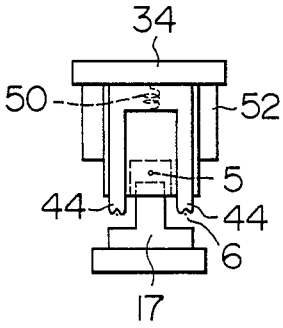
Figure 9E:
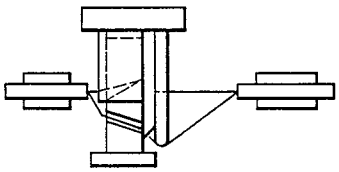

Meanwhile the signal line 5 is cut by the cutter 46 (FIGS. 9C and 9D) and the ground lines are thrusted towards the parts 17*b* of the lower die 17 by the groove portions 44*a* of the plunger 44. FIG. 9D is a scheme of the parts indicated in FIG. 9C seen in the direction of an arrow 9D. When the lower die 48 is further lowered, the ground lines are cut also by the cutter (FIG. 9E).

When formation and cutting of the first signal line is terminated in this way, the shape forming upper and lower dies 18 and 17 are separated and the process proceeds to formation and cutting of the second signal line. That is, the uniaxial table is moved by a distance corresponding to a number of pulses $(C_2-C_1)$ so that the shape forming dies 17 and 18 are put on the second signal line. Next the shape forming die consisting of the upper and lower dies 18 and 17 is closed and the following signal and ground lines are cut.

Then the correction of deviations of the real pitch with respect to the standard pitch p of the signal line is effected by moving the shape forming sharp edged die while holding this state, i.e. holding the core conductor with the shape forming sharp edged die. That is, the difference $\Delta S_2 = S_2 - S_2'$ between the amount of forwarding $S_2$ to the second signal line stored in the RAM and the correct amount of forwarding is obtained and the uniaxial table is moved by an amount corresponding to this $\Delta S_2$. In this way the pitch between the first signal line and the second one is forcedly corrected to the standard pitch p.

The shape forming die is opened thereafter and formation and cutting of the second signal line are terminated.

Formation and cutting of all the following core conductors are effected in the same manner one after another.

Finally the cable clump is loosened and the core conductor treatment of one flat multi-core cable 1 is terminated (Step 90).

Alternatively, cutting of the signal line may be executed after the positional correction of the signal line.

Figure 13:
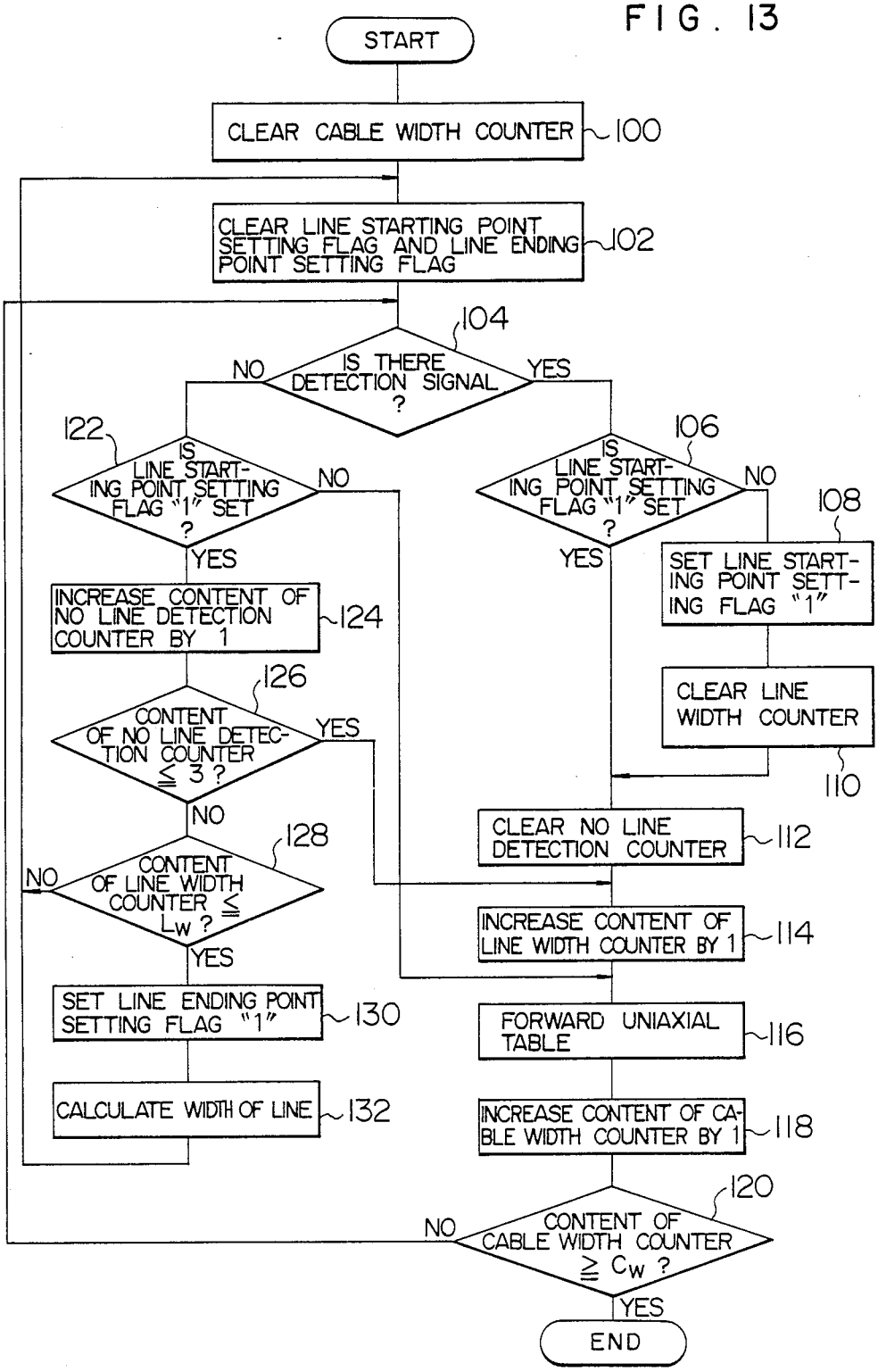
FIG. 13 is a flow chart showing the treatment for detecting the position of the core conductors.

As explained above, according to this invention, the detection signals are correctly treated by the sensing treatment indicated in FIG. 13 and thus it is possible to detect the position of the core conductors and in particular the signal lines. Further, since the formation and cutting treatment is executed after having positioned the signal lines, whose position is correctly detected in this manner, at the shape forming die one after another or every unit consisting of a plurality of signal lines, the signal lines are put correctly on the shape forming die and thus it is possible to reduce remarkably impaired core conductors and deficiences at the work.

Here the tolerated precision of the positioning of the shape forming die in order not to produce impaired core conductors at the work will be explained by citing an example.

Figure 14A:
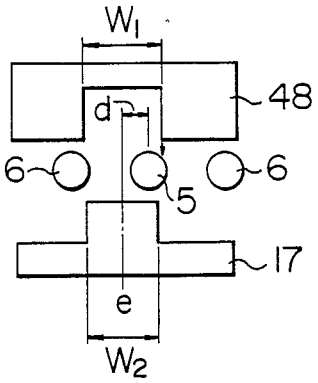
FIGS. 14A and 14B are schemes for explaining the precision of the formation.
Figure 14B:
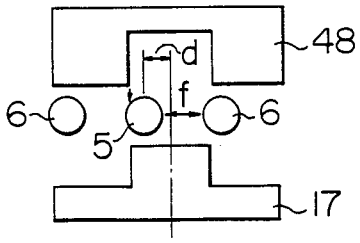

FIGS. 14A and 14B indicate the positional relation among the shape forming upper die, the shape forming lower die and one core conductor. As an example, it is supposed that the diameter of the signal and the ground lines is 0.26 mm, that the width $W_1$ of the groove portion 48*a* in the upper die 48 is 0.4 mm and that the width $W_2$ of the protruding portion 17*a* in the lower die is 0.3 mm.

When the center of the signal line 5 is deviated to right in the figure with respect to the center e of the upper and lower dies, as indicated in FIG. 14A, the right side of the signal line 5 is impaired at the work.

In the same way, when the center of the signal line 5 is deviated to left with respect to the center e of the upper and lower dies, as indicated in FIG. 14B, the left side of the signal line 5 is impaired.

Figure 15:
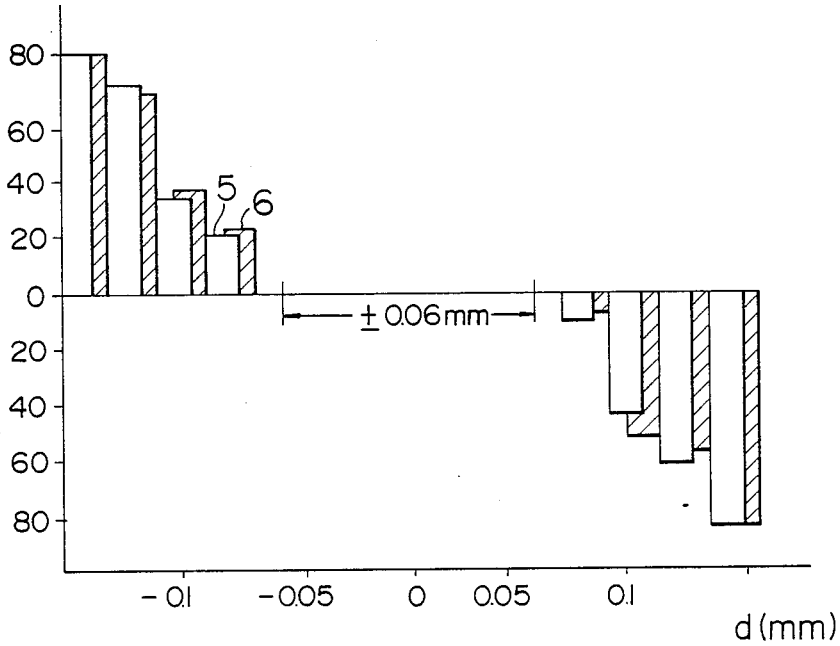
FIG. 15 is a histogram indicating the tolerable positioning precision for the forming operation.

FIG. 15 shows experimental results indicating variations in the probability with which the signal and ground lines are impaired, vs. the amount of deviation d of the center of the signal line 5 with respect to the center e of the upper and lower dies. In the figure white bars and black bars indicate numbers of times that the signal line and the ground line are impaired, respectively. The number of times that the right side thereof is impaired, is indicated on the upper side and the number of times that the left side thereof is impaired. Further, concerning the deviations d. Those to the left are indicated by positive values and those to the right by negative values. As clearly seen from this result, it can be understood that if the deviations d are smaller than 0.06 mm from the center e, the core conductors are not impaired.

When it is supposed that the precision for the interval between two adjacent core conductors in the cable is e.g. ±0.06 mm, according to the prior art formation and treatment lumping all the core conductors, even if the central core conductor is put correctly on the center of the shape forming die, the deviations d for outer core conductors may exceed the tolerance, which gives rise to impairments thereon.

On the contrary, according to this invention, since the core conductors are formed and cut for every core conductor or for every unit consisting of a certain number of core conductors and therefore the deviations are always within the tolerance, they can be formed and cut without impairing them.

Although in the embodiments of this invention described above a transmission type photoelectric sensor with optical fibers is used for the sensor and it is moved on the cable by means of a uniaxial table, a one-dimensional sensor such as a CCD camera may be used for the snesor. Further, although in one embodiment of this invention the sensor and the shape forming sharp edged die are forwarded by means of the uniaxial table, this invention may be realized by fixing the sensor and the shape forming sharp edged die and moving the cable clump. Furthermore, although in the embodiments of this invention the uniaxial table is forwarded by means of a combination of a ball screw and the step motor 12, this invention may be realized by using a linear pulse motor such as a DC servo motor, an AC servo motor, etc. instead of the step motor, if a predetermined forward is executed by sending a pulse thereto. In addition, although in one embodiment of this invention the treatment of the flat type multi-core type cable is executed by forming and cutting the core conductors one after another, it may executed by dividing the core conductors into a plurality of units and forming and cutting them for every unit consisting of a plurality of core conductors.

As explained above, according to this invention, it was made possible to form and cut even a flat type multi-core cable, for which errors in the pitch of the core conductors were relatively large and therefore, for which it was impossible to be worked by means of the prior art comb-shaped lumping shape forming die. Further, since it is possible to correct the pitch of the core conductors so that it is in agreement with the pitch in the pattern on the base plate used in the following fabrication step, even cables, for which errors in the pitch of the core conductors in itself are relatively large, can be used for a high density mounting and it becomes possible to attempt cost-down of the cable. Further, according to this invention, since the pitch of the core conductors is measured before the formation and cutting thereof, in the case where errors in the pitch of the core conductors are extremely large and it is impossible to work them even according to this invention, it is possible to detect this deficiency and to exclude such a flat type multi-core cable.

We claim:

1. An apparatus for forming and cutting a flat type multi-core cable comprising:

clamping means for clamping a flat type multi-core cable, whose core conductors are previously exposed by exfoliating a part of a jacket therefor;

shape forming sharp edged dies capable of holding and cutting exfoliated core conductors, which are divided into a plurality of units, in said flat type multi-core cable for every unit of core conductors;

detecting means, which is located in a predetermined fixed positional relation with respect to said shape forming sharp edged dies, scans said exfoliated core conductors and outputs a detection signal;

position controlling means for controlling the relative position among said shape forming sharp edged dies, said detecting means in said cable;

controlling unit for controlling said shape forming sharp edged dies and said position controlling means on the basis of the detection signal outputted by said detecting means;

memory means for storing previously standard relative distances between each of the units of core conductors in the cable and said shape forming sharp edged dies on the basis of a standard pitch of the units of core conductors in said shape forming sharp edged dies; and calculating means for calculating the relative distances between each of the units of core conductors in the cable and said shape forming sharp edged dies on the basis of said detection signal obtained by varying the relative position of said cable and said detecting means by means of said position controlling means;

wherein said controlling unit executs the following operations for every unit of core conductors; it positions a unit of core conductors at said shape forming sharp edged dies by controlling said position controlling means according to the relative distance thus calculated, corresponding to said unit of core conductors, at the same time controls said position controlling means in the state where said unit of core conductors is held by said shape forming sharp edged dies, so that the relative distance between said unit of core conductors and said shape forming sharp edged dies and the standard relative distance corresponding to said unit of core conductors are in agreement with each other and finally loosens the clamp of said unit of core conductors by aid shape forming sharp edged dies.

2. An apparatus for forming and cutting a flat type multi-core cable according to claim 1, wherein said controlling unit gives said position controlling means a driving signal so as to control said relative position and said calculating means calculates said relative distances on the basis of said detection signal and said driving signal.

3. An apparatus for forming and cutting a flat type multi-core cable according to claim 2, further comprising:

alarm means making known that the cable is deficient, when it is started; and counting means for counting said detection signal;

wherein said memory means stores the number of all the core conductors in said cable, and said controlling unit starts said alarm means, when the counting value of said counting means obtained by the fact that said detecting means scans all the core conductors in said cable and the number of all the core conductors stored in said memory means.

4. An apparatus for forming and cutting a flat type multi-core cable according to claim 2, further comprising:

alarm means making known that the cable is deficient, when it is started;

wherein said calculating means calculates the pitch of the core conductors on the basis of said detection signal and said driving signal and said controlling unit starts said alarm means, when deviations of either one of the units of core conductors calculated by said calculating means exceed a predetermined value.

5. An apparatus for forming and cutting a flat type multi-core cable according to claim 1, wherein said detecting means includes:

means for treating the signal obtained by scanning said core conductors by filling up lacks existing therein; and means for outputting only signals, whose width is greater than a predetermined value, as detection signals, among signals, for which the lacks are thus filled up.

6. A method for forming and cutting a flat type multi-core cable using; clamping means for clamping a flat type multi-core cable, whose core conductors are previously exposed by exfoliating a part of a jacket therefor; shape forming sharp edged dies capable of holding and cutting exfoliated core conductors, which are divided into a plurality of units, in said flat type multi-core cable for every unit of core conductors; and detecting means, which is located in a predetermined fixed positional relation with respect to said shape forming sharp edged dies, scanning said exfoliated core conductors and outputting a detection signal; comprising:

a first step of scanning all the core conductors by said detecting means by varying the relative relation between said cable and said detecting means;

a second step of calculating the relative distances between each of said units of core conductors and said shape forming sharp edged dies on the basis of the detection signal thus obtained by the scanning;

a third step of positioning each of said units of core conductors, using the relative distance thus calculated corresponding thereto for the relative distance from the shape forming sharp edged dies thereto;

a fourth step of holding the unit of core conductors thus positioned to cut it;

a fifth step of locating said unit of core conductors so that the relative distance between said unit of core conductors and the shape forming sharp edged dies and the standard relative distance corresponding thereto; and a sixth step of removing the clamp of said unit of core conductors by said shape forming sharp edged dies, said third to sixth steps being repeated for all the units of core conductors.

7. A method for forming and cutting a flat type multi-core cable according to claim 6, wherein the relative distances corresponding to said units of core conductors are relative distances between each of said units of core conductors in the cable and said shape forming sharp edged dies based on the standard pitch of the core conductors.

8. A method for forming and cutting a flat type multi-core cable according to claim 7, further comprising:

a seventh step of counting the detection signal obtained by said first step;

an eighth step of judging whether the counting value obtained by said seventh step and the number of said core conductors in the cable are in agreement with each other or not; and a ninth step of generating an alarm, when it is judged that they are not in agreement with each other.

9. A method for forming and cutting a flat type multi-core cable according to claim 8, wherein said third to sixth steps are not repeated, after said ninth step has been executed.

10. A method for forming and cutting a flat type multi-core cable according to claim 7, further comprising:

a tenth step of calculating pitches between two adjacent core conductors on the basis of said detection signal obtained by said first step;

an eleventh step of judging whether either one of said pitches of said core conductors thus calculated is greater than the standard pitch or not; and a twelfth step of generating an alarm, when it is judged that either one of said core conductors is greater than the standard pitch.

11. A method for forming and cutting a flat type multi-core cable according to claim 10, wherein said third to sixth steps are not repeated, after said twelfth step has been executed.

12. A method for forming and cutting a flat type multi-core cable according to claim 6, wherein said detecting means treats the signal obtained by scanning said core conductors by filling up lacks existing therein and only signals, whose width is greater than a predetermined value, are outputted as detection signals among signals, for which the lacks are thus filled up.

13. A method for forming and cutting a flat type multi-core cable according to claim 6, wherein said fourth step is executed, after said fifth step has been executed.

* * * * *